US008581502B2

(12) United States Patent
Lee

(10) Patent No.: US 8,581,502 B2
(45) Date of Patent: Nov. 12, 2013

(54) CIRCUIT FOR LIGHT EMITTING DIODES, RELATED INTEGRATED CIRCUIT AND CONTROL METHOD

(75) Inventor: Ching-Tsan Lee, Hsin-Chu (TW)

(73) Assignee: Leadtrend Technology Corp., Science-Based Industrial Park, Hsin-Chu (TW)

( * ) Notice: Subject to any disclaimer, the term of this patent is extended or adjusted under 35 U.S.C. 154(b) by 203 days.

(21) Appl. No.: 13/276,322

(22) Filed: Oct. 19, 2011

(65) Prior Publication Data

US 2012/0098459 A1 Apr. 26, 2012

(30) Foreign Application Priority Data

Oct. 26, 2010 (TW) ..... 99136526 A

(51) Int. Cl.
*H05B 41/00* (2006.01)

(52) U.S. Cl.
USPC ..... 315/185 R; 315/291; 315/299; 315/307; 315/308

(58) Field of Classification Search
USPC ..... 315/308, 185 R, 299
See application file for complete search history.

(56) References Cited

U.S. PATENT DOCUMENTS

| | | | | |
|---|---|---|---|---|
| 4,797,608 | A * | 1/1989 | White | 324/96 |
| 6,704,183 | B2 * | 3/2004 | Stafford | 361/93.7 |
| 7,075,766 | B2 * | 7/2006 | Moyer et al. | 361/93.1 |
| 7,667,940 | B2 * | 2/2010 | Turpin et al. | 361/93.1 |
| 7,839,610 | B2 * | 11/2010 | Yamamoto et al. | 361/30 |
| 2009/0115390 | A1 * | 5/2009 | Chen et al. | 323/283 |
| 2010/0231132 | A1 * | 9/2010 | Logiudice et al. | 315/161 |

* cited by examiner

*Primary Examiner* — Daniel Cavallari
*Assistant Examiner* — Christine Johnson
(74) *Attorney, Agent, or Firm* — Winston Hsu; Scott Margo

(57) ABSTRACT

A control circuit controls driving of an LED and a current-controlled device controls current through the LED. The current-controlled device has a control node. The control circuit has a driving circuit and a fault detector. In the driving circuit, a first comparator compares a current-setting signal with a sensing signal to generate a first comparison signal. Based on the first comparison signal, a buffer generates a driving signal to the control node and drives the current-controlled device. Within the fault detector, a second comparator compares the first comparison signal with the driving signal, generating a second comparison signal. A third comparator compares the driving signal with a threshold voltage, generating a third comparison signal. A fourth comparator compares the sensing signal with the current-setting signal, generating a fourth comparison signal. A decision maker enables or disables the driving circuit according to the second, third, and fourth comparison signals.

7 Claims, 4 Drawing Sheets

CIRCUIT FOR LIGHT EMITTING DIODES, RELATED INTEGRATED CIRCUIT AND CONTROL METHOD

BACKGROUND OF THE INVENTION

1. Field of the Invention

The present invention relates to control circuits for light-emitting diodes (LEDs), and particularly to a related integrated circuit and method for controlling LEDs.

2. Description of the Prior Art

Light-emitting diodes (LEDs) have a very good electro-optical conversion rate, which is higher than fluorescent lamps, cold-cathode fluorescent lamps, and light bulbs. Thus, the current trend is to replace these types of lamps with LEDs. For example, LEDs have already gradually replaced CCFLs as a backlight source in liquid crystal display (LCD) panels.

FIG. 1 is a diagram of an LED voltage supply circuit. Grid AC power goes through power management circuit 12, is transformed by transformer 14, and outputted through terminal OUT as output voltage $V_{OUT}$. Through voltage divider 18, 20, Zener diode LT431, and photocoupler 16, output voltage $V_{OUT}$ is fed back to power management circuit 12, so as to regulate output voltage $V_{OUT}$. N LED chains CLED1 . . . CLEDN are connected to output voltage $V_{OUT}$ as light sources. Controllable current sources I1 . . . IN have approximately the same internal circuitry, each corresponds individually to one of the LED chains CLED1 . . . CLEDN, and controls LED chain brightness by controlling current flowing through each LED chain.

FIG. 2 illustrates one configuration of controllable current source I1 of FIG. 1. Error amplifier EA1 controls power transistor M1, and changes current flowing through LED chain CLED1 and sense resistor CS1, in an attempt to make voltages of sensing signal $V_{SENSE1}$ and current-setting signal $V_{LEDBIAS}$ the same. Sense resistors CS1 . . . CSN have approximately the same resistance. If sensing signals $V_{VSENSE1} \ldots V_{SENSEN}$ have voltage approximately equal to current-setting signal $V_{LEDBIAS}$, it can be deduced that current flowing through each LED in FIG. 2 is approximately the same.

Short and open circuits among the circuit components, including LED current sources, lead to abnormal operation, and can even cause mortal danger. For example, if the sense resistor CS1 of FIG. 2 is shorted (resistance is zero), brightness of LED chain CLED1 will be overly bright, or LED chain CLED1 may even burn up. Thus, errors should be detected as early as possible, so as to implement appropriate protection measures.

SUMMARY OF THE INVENTION

According to an embodiment, a light-emitting diode (LED) control circuit is for controlling and driving at least an LED, through which a current is controlled by a current-controlled device comprising a control node. The control circuit comprises a driving circuit and a fault detector. The driving circuit comprises a first comparator and a relay circuit. The first comparator is for comparing a sensing signal and a current-setting signal to generate a first comparison signal. Voltage of the sensing signal represents the current flowing through the LED. The relay circuit is for generating a driving signal according to the first comparison signal, and outputting the driving signal to the control node for driving the current-controlled device. The fault detector comprises a second comparator, a third comparator, a fourth comparator, and a decision maker. The second comparator is for comparing the first comparison signal and the driving signal to generate a second comparison signal. The third comparator is for comparing the driving signal and a threshold voltage to generate a third comparison signal. The fourth comparator is for comparing the sensing signal and the current-setting signal to generate a fourth comparison signal. The decision maker is for enabling or disabling the driving circuit according to the second, third, and fourth comparison signals.

According to an embodiment, a method is provided for controlling driving of at least one LED, through which current is controlled by a current-controlled device comprising a control node. The method comprises comparing a sensing signal and a current-setting signal for generating a first comparison signal, wherein the sensing signal represents the current flowing through the LED, providing a driving signal to the control, and making voltage of the driving signal follow roughly a voltage level of the first comparison signal, comparing the driving signal and the first comparison signal, and asserting a second comparison signal when the driving signal is different from the first comparison signal in at least a first predetermined bias value, comparing the driving signal and a threshold voltage, and asserting a third comparison signal when the driving signal exceeds a threshold voltage, comparing the sensing signal and the current-setting signal, and asserting the third comparison signal when the sensing signal and the current-setting signal are different in at least a second predetermined bias value, and holding the current-controlled device in an off state when any of the second, third, and fourth comparison signals is asserted.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
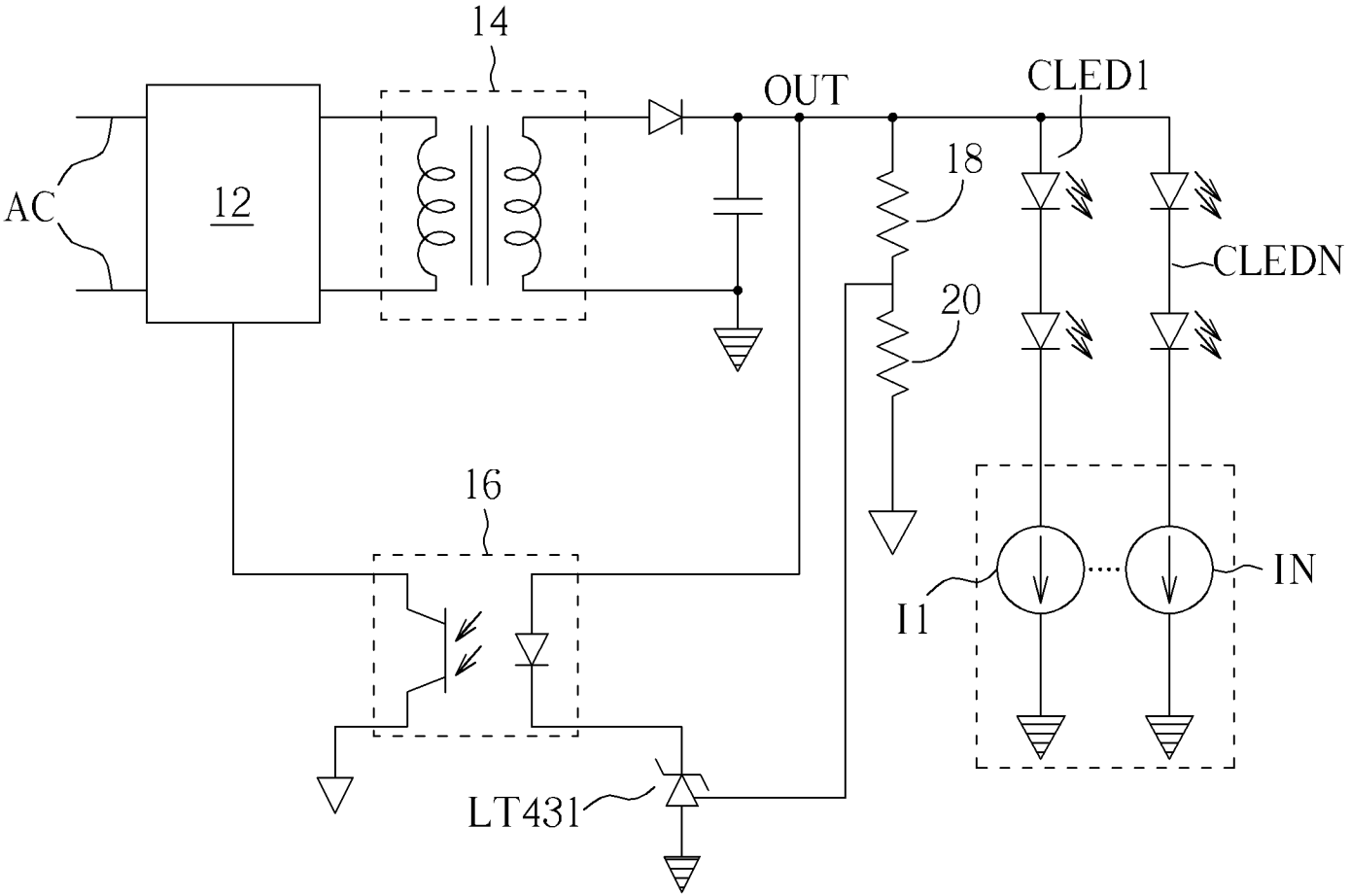
FIG. 1 PRIOR ART
FIG. 1 is a diagram of an LED voltage supply circuit.
Figure 2:
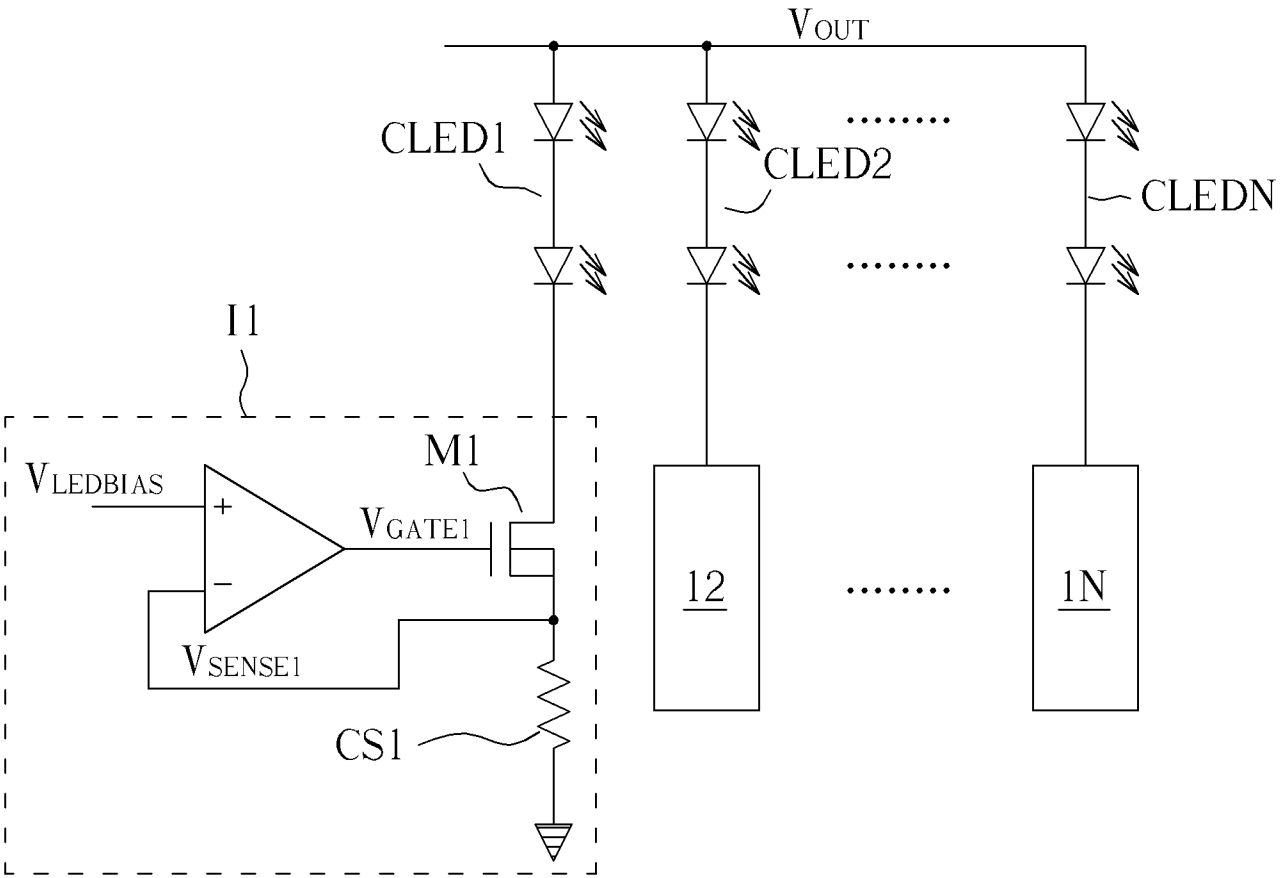
FIG. 2 PRIOR ART
FIG. 2 illustrates one configuration of controllable current source I1 of FIG. 1.
Figure 3:
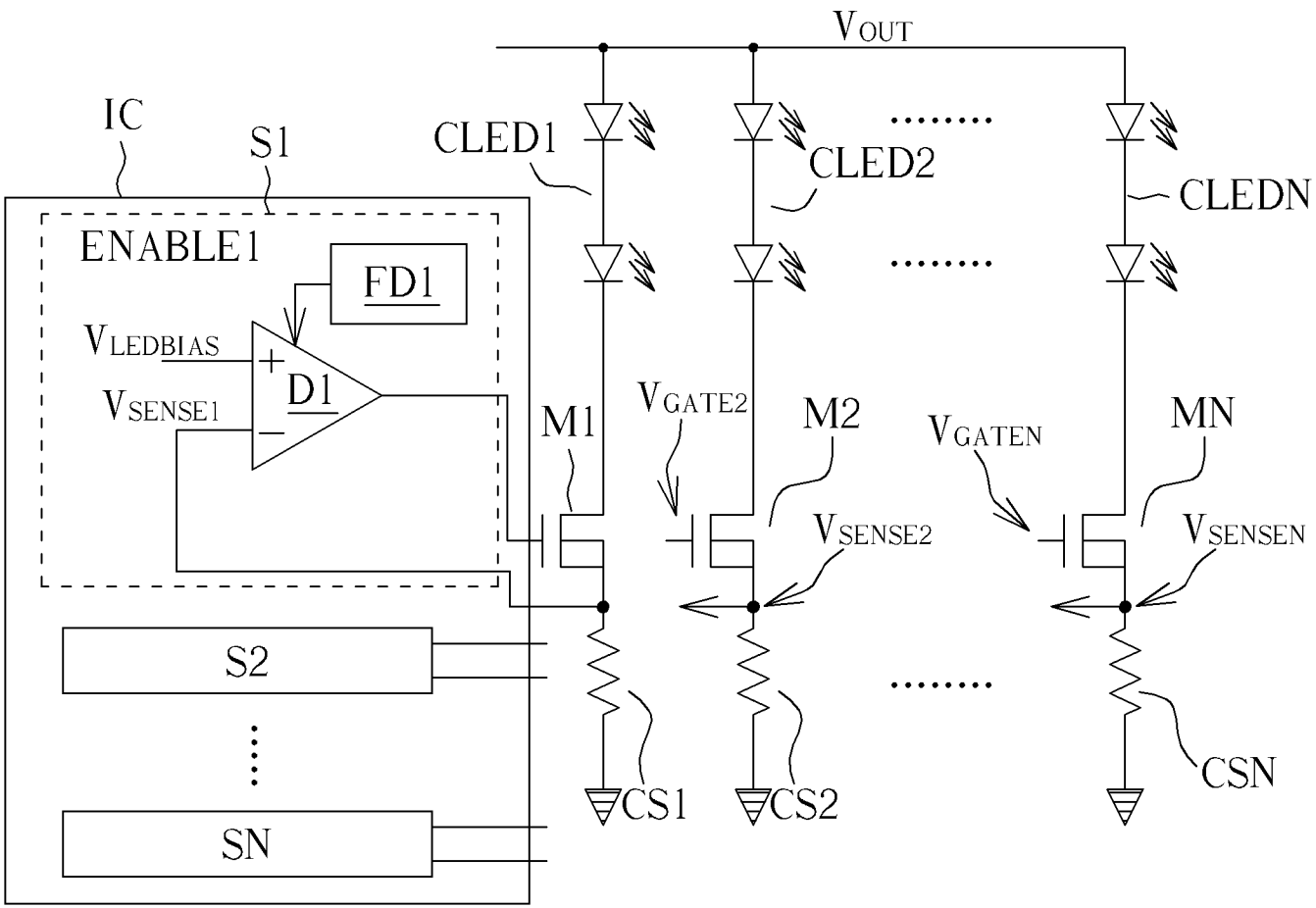
FIG. 3 illustrates an integrated circuit IC and related circuitry.

FIG. 3 illustrates an integrated circuit IC and related circuitry for driving and controlling LED chains CLED1 . . . CLEDN according to an embodiment. Integrated circuit IC comprises control circuits S1 . . . SN that use driving signals $V_{GATE1} \ldots V_{GATEN}$ to control respective power transistors M1 . . . MN, and receive sensing signals $V_{SENSE1} \ldots V_{SENSEN}$ generated by sense resistors CS1 . . . CSN. In this embodiment, control circuits S1 . . . SN have approximately the same circuitry, but in other embodiments, control circuits S1 . . . SN may be different.

In the following, LED chain CLED1 and control circuit S1 are taken as an example to describe all LED chains and control circuits of the integrated circuit IC of FIG. 3. LED chain CLED1, power transistor M1, and sense resistor CS1 are connected in series. Control circuit S1 comprises driving circuit D1 and fault detector FD1. Driving circuit D1 compares sensing signal $V_{SENSE1}$ and current-setting signal $V_{LEDBIAS}$ to generate driving signal $V_{GATE1}$ for controlling power transistor M1 and current thereof. In the following, current-setting signal $V_{LEDBIAS}$ is taken to be 0.8 Volts as an example. Fault detector FD1 detects signals of driving circuit D1 for determining whether or not a fault has occurred, so as to take appropriate action in a timely manner.

Figure 4:
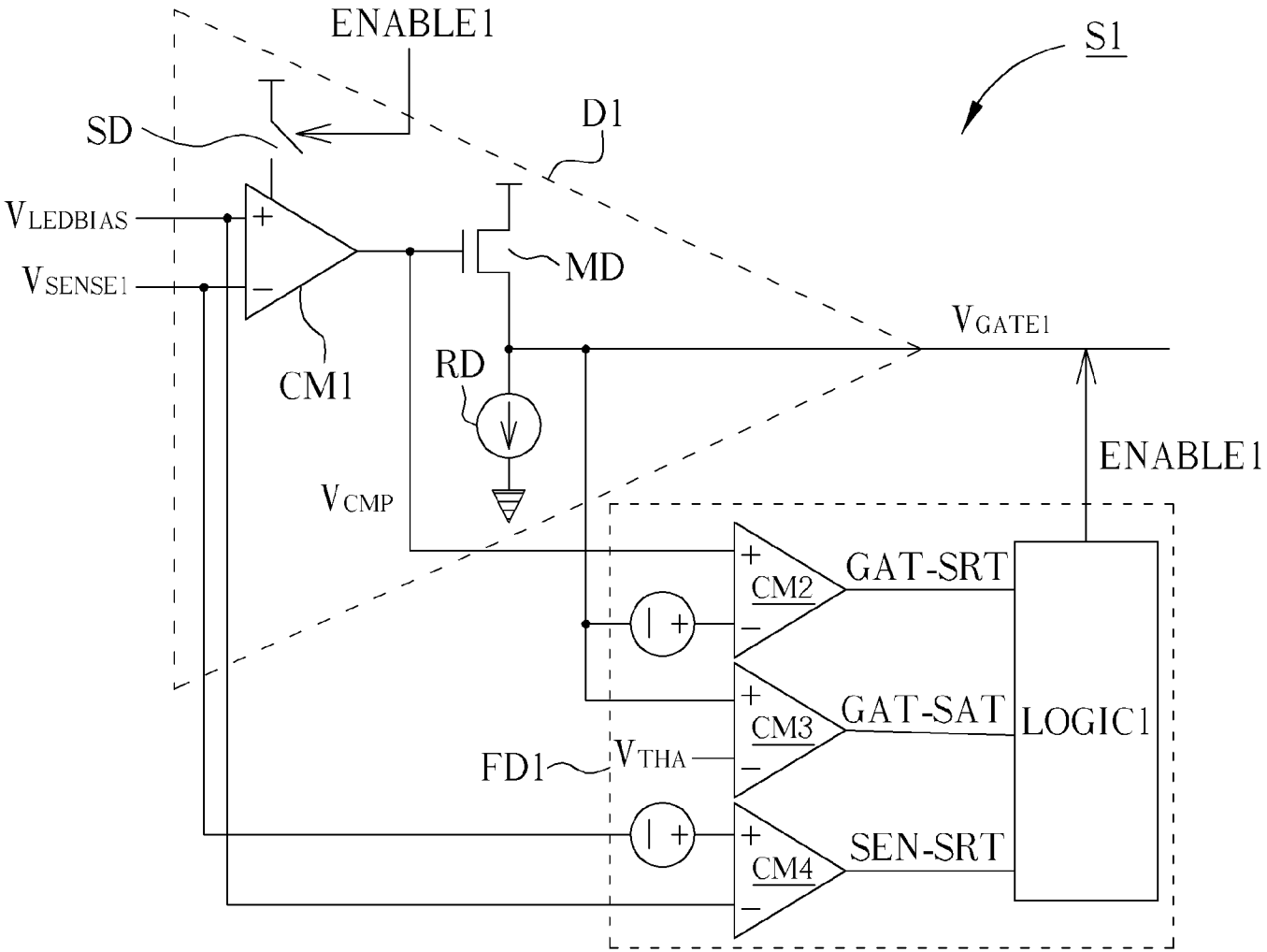
FIG. 4 is a circuit diagram of control circuit S1 of FIG. 3.

FIG. 4 is a circuit diagram of control circuit S1 of FIG. 3. In driving circuit D1, comparator CM1 may be realized as an error amplifier, and compares sensing signal $V_{SENSE1}$ and current-setting signal $V_{LEDBIAS}$ to generate comparison signal $V_{CMP}$. Voltage of sensing signal $V_{SENSE1}$ represents current flowing through sense resistor CS1 or LED chains CLED1. MOS transistor MD and current source RD form a source follower, which acts as a relay circuit for generating driving signal $V_{GATE1}$ according to comparison signal $V_{CMP}$ to drive power transistor M1. When LED chain CLED1 is driven normally without any faults occurring, sensing signal $V_{SENSE1}$ has voltage approximately equal to voltage of current-setting signal $V_{LEDBIAS}$, and driving signal $V_{GATE1}$ and comparison signal $V_{CMP}$ differ approximately by threshold voltage VTH of MOS transistor MD. Relay circuit may be used for increasing driving ability of driving circuit D1, and may also be realized by other circuits, e.g. an emitter follower or class-AB amplifier.

Fault detector FD1 comprises three comparators CM2, CM3, CM4, and decision maker LOGIC1. Comparator CM2 detects difference between driving signal $V_{GATE1}$ and comparison signal $V_{CMP}$. For example, if comparison signal $V_{CMP}$ exceeds driving signal $V_{GATE1}$ by at least 1.5 Volts, comparison signal GAT-SRT is asserted. Comparator CM3 observes driving signal $V_{GATE1}$ and threshold voltage $V_{THA}$. For example, if driving signal $V_{GATE1}$ is higher than 4 Volt threshold voltage $V_{THA}$, comparison signal GAT-SAT is asserted. Comparator CM4 detects difference between current-setting signal $V_{LEDBIAS}$ and sensing signal $V_{SENSE1}$. For example, if current-setting signal $V_{LEDBIAS}$ exceeds sensing signal $V_{SENSE1}$ by at least 0.4 Volts, comparison signal SEN-SRT is asserted. Decision maker LOGIC1 may perform a logic operation on comparison signals GAT-SRT, GAT-SAT, SEN-SRT to disassert or assert control signal ENABLE1. For example, when one of comparison signals GAT-SRT, GAT-SAT, SEN-SRT is asserted, a fault is assumed to have occurred, so control signal ENABLE1 is disasserted, thereby turning off switch SD of driving circuit D1, so that driving signal $V_{GATE1}$ keeps power transistor M1 shut off, and LED chain CLED1 is not supplied any current.

During normal operation or start-up, control signal ENABLE1 is asserted, so that driving circuit D1 drives power transistor M1 normally. Fault detector FD1 may properly discover the occurrence of various faults, which are described below.

When control terminal of power transistor M1 is constantly shorted to ground, driving signal $V_{GATE1}$ is always 0 Volts, such that sensing signal $V_{SENSE1}$ is also 0 Volts. Thus, comparison signals GAT-SRT, SEN-SRT are asserted, thereby disasserting control signal ENABLE1, so that driving circuit D1 does not waste energy continuously driving power transistor M1.

When an open circuit exists between control terminal of power transistor M1 and driving circuit D1, driving signal $V_{GATE1}$ saturates, and exceeds threshold voltage $V_{THA}$, such that comparison signal GAT-SAT is asserted. At this time, sensing signal $V_{SENSE1}$ is also 0 Volts, so comparison signal SEN-SRT is asserted. Thus, driving circuit D1 is disasserted.

When one LED in LED chain CLED1 is open circuited, or when LED chain CLED1 is disconnected from power transistor M1, sensing signal $V_{SENSE1}$ is 0 Volts, and driving signal $V_{GATE1}$ saturates. Thus, comparison signals GAT-SAT, SEN-SRT are asserted, and driving circuit D1 is disasserted.

When sense resistor CS1 is shorted, sensing signal $V_{SENSE1}$ is 0 Volts, and driving signal $V_{GATE1}$ is saturated, so that comparison signals GAT-SAT, SEN-SRT are asserted, driving circuit D1 is disasserted, and forced to shut off current in LED chain CLED1, thereby preventing excessive current from burning up LED.

When power transistor M1 is not connected to sense resistor CS1, sensing signal $V_{SENSE1}$ is 0 Volts, and driving signal $V_{GATE1}$ is saturated. Thus, comparison signals GAT-SAT, SEN-SRT are asserted, and driving circuit D1 is disasserted.

From the above description, it can be seen that fault detector FD1 can determine occurrences of multiple faults, thereby stopping current in LED chain CLED1, and preventing dangerous situations arising.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) control circuit for controlling and driving at least an LED, through which a current is controlled by a current-controlled device comprising a control node, the LED control circuit comprising:

a driving circuit comprising:

a first comparator for comparing a sensing signal and a current-setting signal to generate a first comparison signal, wherein voltage of the sensing signal represents the current flowing through the LED; and a relay circuit for generating a driving signal according to the first comparison signal, and outputting the driving signal to the control node for driving the current-controlled device; and a fault detector comprising:

a second comparator for comparing the first comparison signal and the driving signal to generate a second comparison signal;

a third comparator for comparing the driving signal and a threshold voltage to generate a third comparison signal;

a fourth comparator for comparing the sensing signal and the current-setting signal to generate a fourth comparison signal; and a decision maker for enabling or disabling the driving circuit according to the second, third, and fourth comparison signals.

2. The LED control circuit of claim 1, wherein the second comparator determines whether the first comparison signal exceeds the driving signal by at least a predetermined bias value, thereby generating the second comparison signal.

3. The LED control circuit of claim 1, wherein the fourth comparator determines whether the sensing signal is lower than the current-setting signal by at least a predetermined bias value, thereby generating the fourth comparison signal.

4. The LED control circuit of claim 1, wherein the relay circuit is a source follower or an emitter follower.

5. The LED control circuit of claim 1, wherein the second comparison signal is asserted when the first comparison signal exceeds the driving signal by at least a first predetermined bias value; the third comparison signal is asserted when the driving signal exceeds the threshold voltage; the fourth comparison signal is asserted when the sensing signal and the current-setting signal are different in at least a second predetermined bias value; and the driving circuit is disabled when any of the second, third, and fourth comparison signals is asserted.

6. An integrated circuit for controlling a plurality of LED chains, each LED chain comprising a plurality of LEDs, the integrated circuit comprising:

a plurality of the LED control circuit of claim 1, each control circuit controlling a corresponding current-controlled device, which is electrically connected in series with a corresponding current sensor, the corresponding current sensor providing a corresponding sensing signal.

7. A method of controlling driving of at least an LED, through which a current is controlled by a current-controlled device comprising a control node, the method comprising:

comparing a sensing signal and a current-setting signal for generating a first comparison signal, wherein the sensing signal represents the current flowing through the LED;

providing a driving signal to the control node, and making a voltage level of the driving signal follow roughly a voltage level of the first comparison signal;

comparing the driving signal and the first comparison signal, and asserting a second comparison signal when the driving signal is different from the first comparison signal in at least a first predetermined bias value;

comparing the driving signal and a threshold voltage, and asserting a third comparison signal when the driving signal exceeds a threshold voltage;

comparing the sensing signal and the current-setting signal, and asserting the third comparison signal when the sensing signal and the current-setting signal are different in at least a second predetermined bias value; and holding the current-controlled device in an off state when any of the second, third, and fourth comparison signals is asserted.

* * * * *